US007019658B1

(12) United States Patent
Erickson et al.

(10) Patent No.: US 7,019,658 B1
(45) Date of Patent: Mar. 28, 2006

(54) CABLE TRAFFIC INDICATOR

(75) Inventors: Craig S. Erickson, Stevenson Ranch, CA (US); David Naghi, Los Angeles, CA (US); Herschel Naghi, Los Angeles, CA (US)

(73) Assignee: Mobi Technologies, Inc., Beverly Hills, CA (US)

( * ) Notice: Subject to any disclaimer, the term of this patent is extended or adjusted under 35 U.S.C. 154(b) by 85 days.

(21) Appl. No.: 10/677,994

(22) Filed: Oct. 2, 2003

Related U.S. Application Data

(60) Provisional application No. 60/451,833, filed on Mar. 4, 2003.

(51) Int. Cl.
*G08B 21/00* (2006.01)

(52) U.S. Cl. ..... 340/635; 340/654; 340/660; 340/815.45

(58) Field of Classification Search ..... 340/635, 340/686.1, 687, 660, 661, 656, 815.45, 654
See application file for complete search history.

(56) References Cited

U.S. PATENT DOCUMENTS 3,471,784 A * 10/1969 Arndt et al. ..... 324/126
4,890,102 A 12/1989 Oliver
4,945,341 A * 7/1990 Buttimer ..... 340/568.3
5,051,733 A * 9/1991 Neuhouser ..... 340/660
5,065,142 A * 11/1991 Green ..... 340/660
5,081,627 A * 1/1992 Yu ..... 714/46
5,225,816 A * 7/1993 Lebby et al. ..... 340/653
5,475,371 A * 12/1995 Dunk et al. ..... 340/660
5,892,430 A * 4/1999 Wiesman et al. ..... 340/310.01
5,969,632 A * 10/1999 Diamant et al. ..... 340/5.3
6,095,851 A 8/2000 Laity et al.
6,159,037 A 12/2000 Madsen et al.
6,165,006 A * 12/2000 Yeh et al. ..... 439/490
6,241,550 B1 6/2001 Laity et al.
6,256,318 B1 * 7/2001 O'Callaghan et al. ..... 370/447
6,259,170 B1 7/2001 Limoge et al.
6,300,877 B1 10/2001 Schannach et al.
6,361,357 B1 3/2002 Stillwell et al.
6,428,361 B1 8/2002 Imschweiler et al.
6,431,906 B1 8/2002 Belopolsky
6,448,901 B1 9/2002 Adams et al.
6,456,091 B1 9/2002 Lee et al.
6,456,204 B1 * 9/2002 Riley et al. ..... 340/815.45
6,483,712 B1 * 11/2002 Oliphant et al. ..... 361/737
6,577,243 B1 6/2003 Dannenmann et al.
6,765,479 B1 * 7/2004 Stewart ..... 340/310.01

OTHER PUBLICATIONS

Monster Cable—Computer, http://www.monstercable.com/computer/, 1 page.
Monster Computer, http://www.monstercable.com/computer/printer.asp, pp. 1-2.

(Continued)

*Primary Examiner*—Daniel Wu
*Assistant Examiner*—Travis R. Hunnings
(74) *Attorney, Agent, or Firm*—Christie, Parker & Hale, LLP

(57) ABSTRACT

A cable providing a visual indication of traffic including a wire and connector. The connector includes detection circuitry capable of detecting traffic on the cable and generating a detection signal responsive to the traffic. A traffic indicator provides the visual indication of the traffic responsive to the detection signal. The detection circuitry includes driving circuitry coupled to the wire, that carries a data signal. The detection circuitry also includes a transistor. The driving circuitry drives the transistor responsive to the data signal to generate the detection signal, which is used to drive the traffic indicator. The connector may have an inner casing for partially enveloping the detection circuitry, and an outer casing for partially enveloping the inner casing.

16 Claims, 11 Drawing Sheets

OTHER PUBLICATIONS

Monster Computer—High Speed, Maximum Performance DataSafe™ Printer to PC IEEE 1284 Connection, http://www.monstercable.com/computer/productPageComputer.asp?pin=383, pp. 1-2.

Monster Computer—Printer to PC IEEE 1284 Connection with Winky Blinky, http://www.monstercable.com/computer/productPageComputer.asp?pin=917, pp. 1-2.

Printer to PC IEEE 1284 Connection with Winky Blinky, http://www.monstercable.com/ProductPopup.asp?pin=917&holder=photoLrg, 1 page.

Printer to PC IEEE 1284 Connection with Winky Blinky, http://www.monstercable.com/product/Popup.asp?pin=917&holder=photoAlt1, 1 page.

* cited by examiner

CABLE TRAFFIC INDICATOR

CROSS-REFERENCE TO RELATED APPLICATION(S)

This application claims priority of U.S. Provisional Application No. 60/451,833 entitled "Cable Traffic Indicator" filed Mar. 4, 2003, the contents of which are fully incorporated by reference herein.

FIELD OF THE INVENTION

The present application relates generally to communication systems, and more particularly to an indicator for detecting traffic in a cable.

BACKGROUND

There typically is no way to visually monitor traffic or activity in parallel or serial cables. Hence, it is possible for a user to inadvertently interrupt data traffic by unplugging the cable while there is an on-going traffic in the cable. Further, there typically is no way of visually checking whether or not a port is functional. Therefore, it is desirable to provide an apparatus and method for visibly checking port status and/or traffic on a cable.

SUMMARY

In an exemplary embodiment according to the present invention, a cable capable of providing a visual indication of traffic is provided. The cable includes: one or more wires; and at least one connector connected to the wires, said connector having detection circuitry capable of detecting the traffic on the cable and generating a detection signal responsive to the traffic, and a traffic indicator coupled to the detection circuitry to provide the visual indication of the traffic responsive to the detection signal. The detection circuitry includes: driving circuitry coupled to at least one said wire, said at least one said wire carrying a data signal; and a transistor coupled to the driving circuitry and the traffic indicator, wherein the driving circuitry drives the transistor responsive to the data signal to generate the detection signal, which is used to drive the traffic indicator.

In another exemplary embodiment according to the present invention, an adapter for a cable having one or more wires to provide a visual indication of traffic on the cable is provided. The adapter includes: a first plug for interfacing with the cable; a second plug for interfacing between the first plug and an electronic device; and detection circuitry capable of detecting the traffic on the cable and generating a detection signal responsive to the traffic, and a traffic indicator coupled to the detection circuitry to provide the visual indication of the traffic responsive to the detection signal. The detection circuitry includes: driving circuitry coupled to at least one said wire in use, said at least one said wire carrying a data signal; and a transistor coupled to the driving circuitry and the traffic indicator, wherein the driving circuitry in use drives the transistor responsive to the data signal to generate the detection signal, which is used to drive the traffic indicator.

In yet another exemplary embodiment according to the present invention, a traffic detector that can detect traffic in a cable having one or more wires for connecting a computer to a peripheral device is provided. The traffic detector includes: detection circuitry capable of detecting electromagnetic radiation generated by the traffic in at least one of the wires, and of generating a detection signal in response; and a traffic indicator capable of receiving the detection signal, and of providing a visual indication of the traffic responsive to the detection signal.

In still another exemplary embodiment according to the present invention, hub/switch capable of providing a visual indication of traffic on at least one cable is provided. The hub/switch includes: detection circuitry capable of detecting the traffic on said at least one cable and generating a detection signal responsive to the traffic; and at least one traffic indicator coupled to the detection circuitry to provide the visual indication of the traffic responsive to the detection signal. The detection circuitry includes: driving circuitry coupled to at least one wire of said at least one cable, said at least one wire carrying a data signal; and a transistor coupled to the driving circuitry and said at least one traffic indicator, wherein the driving circuitry drives the transistor responsive to the data signal to generate the detection signal, which is used to drive said at least one traffic indicator.

These and other aspects of the invention will be more readily comprehended in view of the discussion herein and accompanying drawings, in which like reference numerals denote like elements.

DETAILED DESCRIPTION

Figure 1:
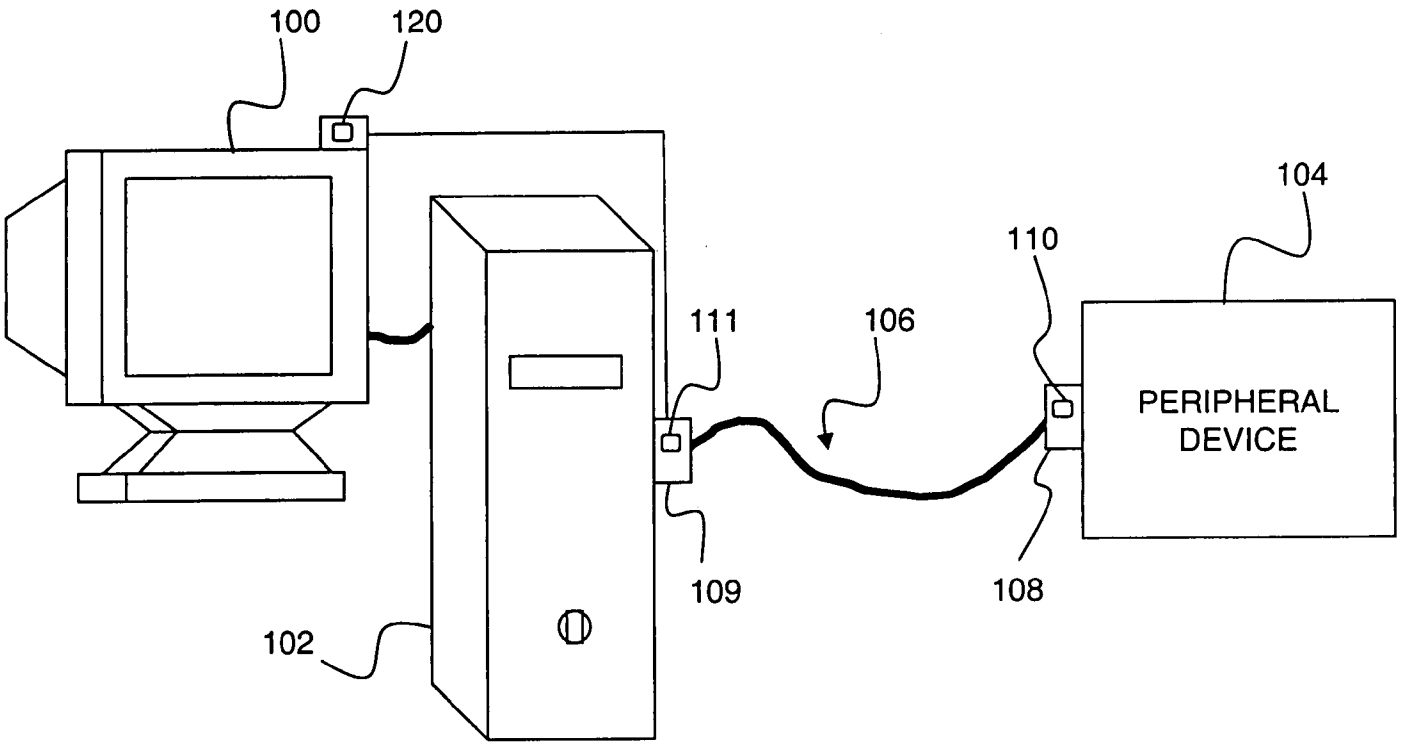
FIG. 1 is a system diagram of a computer and a peripheral device connected by a cable having a traffic indicator in an exemplary embodiment in accordance with aspects of the present invention.

FIG. 1 is a system diagram of a computer 102 and a peripheral device 104 connected by a cable 106 having traffic indicators 110 and 111 in an exemplary embodiment in accordance with aspects of the present invention. The cable 106 is a parallel or serial communication cable, such as, a USB (Universal Serial Bus), FireWire, COM, LPT, SCSI cable or the like. The computer 102 is also coupled to a display device 100 (which may be a computer monitor, for example).

In the exemplary embodiment, the traffic indicator 110 is mounted on and integrated with a connector 108 of the cable 106. Similarly, the traffic indicator 111 is mounted on and integrated with a connector 109 of the cable 106. In other embodiments, the traffic indicators may be integrated with the cable at any point on the cable without being limited to the ends (i.e., at the connectors). The traffic indicators 110 and 111 provide a visual indication (e.g., light flashing) when there is traffic (or activity) in the cable 106. The traffic may include video, audio (such as voice) and data traffic, and may be a high speed traffic (e.g., >10 Mb/s (Mega bits per second)).

In the exemplary embodiment, each of the traffic indicators 110 and 111 includes one or more light emitting diodes (LEDs) that flash in response to traffic in the cable. The LEDs may have red, yellow, green, blue or any other available colors. When the communication signals are running at high speeds (e.g., >10 Mb/s), the user may not be able to see the flashing taking place. Hence, the LEDs may also include one or more auto-flashing LEDs. This way, the LEDs may also be flashing to provide a clearer indication to the user during high speed communications. Other types of indicators may alternatively be used.

In the exemplary embodiment of FIG. 1, a traffic indicator 120 (e.g., one or more LEDs) is mounted on the display device 100 so that it is easily visible to the user. The traffic indicator 120, for example, is electrically connected to the connector 109 to receive a detection signal used to operate the traffic indicator 120. The traffic indicator 120 may also be located at other visible locations.

The LED-based traffic indicators are desirable in low power applications since LEDs consume little power. However, in other embodiments, the traffic indicators may include other types of illuminating devices, such as, electroluminescent lamps, a translucent end of the cable (or connector), or the like. Translucent connector ends or translucent wire coverings would allow light to be dispersed within and appear, respectively, as though entire ends of a cable is glowing or the wire coverings are conducting the light. The translucent connector ends or the wire coverings may be clear or colored/tinted.

FIG. 1 illustrates an exemplary embodiment in which the traffic indicators 110 and 111 are on both the peripheral device side and the computer side, respectively of the cable. In other embodiments, the traffic indicator may be mounted on the connector on the computer side or the peripheral device side, but not on both sides. The traffic indicators in the exemplary embodiments generate a visual indication in response to traffic detected through monitoring data on at least one of the wires (that carries data) in the cable that are connected to pins of the connectors.

In addition to showing communications taking place on cables that normally do not have status indicator on them, and providing capabilities to visually check whether or not a port is functional, the traffic indicators in exemplary embodiments of the present invention add 'visual accent' to otherwise dull and plain cables, so as to make them aesthetically appealing to the users.

Figure 2:
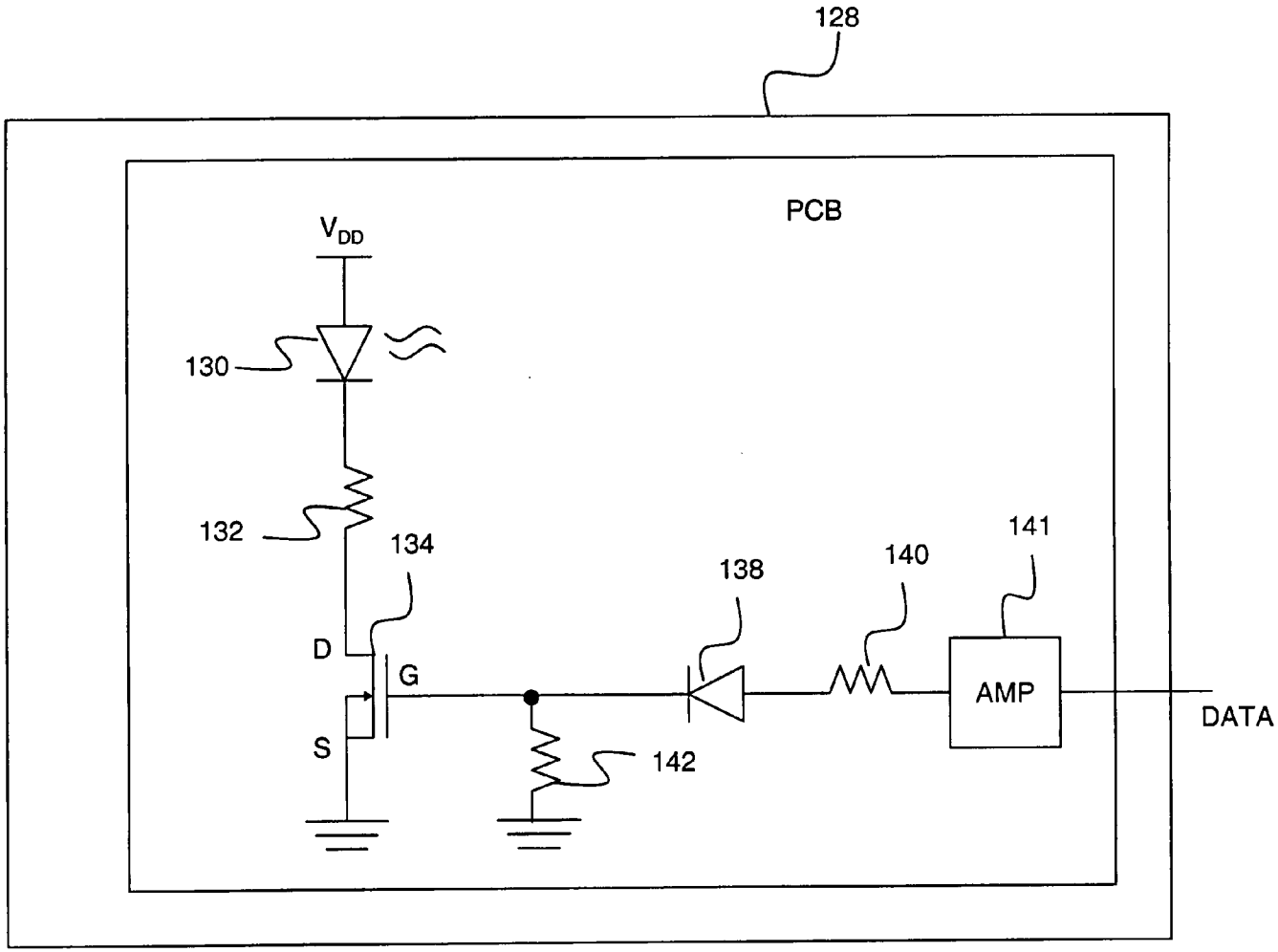
FIG. 2 is a schematic diagram of a connector in an exemplary embodiment in accordance with aspects of the present invention.

FIG. 2 is a schematic diagram of a connector 128 of a cable in an exemplary embodiment in accordance with aspects of the present invention. The schematic diagram of FIG. 2 is a simplified representation of a connector; in practice, of course, a connector would contain other components, such as pins, wires and the like. The circuitry illustrated on the schematic diagram of FIG. 2 is mounted on a printed circuit board (PCB), and may also be referred to as a filtering circuit or detection circuitry.

The connector 128, for example, may be applied as the connector 108 and/or the connector 109 of FIG. 1. The connector 128 has a traffic indicator in the form of an LED 130. Hence, the LED 130 may correspond to the traffic indicator 110 and/or the traffic indicator 111. If the cable carries power in one of its wires, the voltage source $V_{DD}$ for the LED 130 may be provided by the power in the cable. For example, if the connector 128 is a USB connector, voltage source $V_{DD}$ may be supplied by its power pin/wire. If power is not available in any of the wires, the $V_{DD}$ may be supplied by an external battery/AC power. Further, in case of a USB cable, data received by the connector 128 may be a USB DP (Data +) signal. Here and elsewhere in this application, the term "data" is used broadly to include video, audio and/or other data. Further, the wire that carries data may be referred to as a data line.

In the connector 128, the LED 130 is disposed between the voltage source $V_{DD}$ and a resistor 132. The other end of the resistor 132 is coupled to a drain of a transistor 134, which is a field effect transistor (FET), such as NDS7002 available from Fairchild Semiconductor. In other embodiments, other types of suitable transistors may be used.

The transistor 134 detects (i.e., senses) the communications taking place on the data line without creating a significant signal drain on the line so as to attenuate the data signal. A source of the transistor 134 is coupled to ground. The data is received by an amplifier 141 in the connector 128 for amplification of the data signal. The amplifier 141, for example, may be an operational amplifier (op-amp). The amplified data is then passed through a resistor 140 and a diode 138 to be applied at a gate of the transistor 134. The gate of the transistor 134 is also coupled to ground via a resistor 142. In other embodiments, the amplifier 141 may not be used, and the received data may be directly applied to the resistor 140.

In operation, the data transitions between high and low, and thereby drives the transistor 134 at its gate. When the data signal is high, the transistor 134 turns on and conducts current. As the current flows through the transistor 134, it flows through the LED 130 and the resistor 132, voltage drop occurs across the LED 130, and the LED 130 lights up. When the data signal is low, the transistor 134 turns off, and substantially no current flow through it or the LED 130. Therefore, the LED does not light up. Hence, with the data transitioning between high and low, the LED turns on and off (or flashes) to indicate that there is traffic in the cable connected to the connector 128. If there is no data signal, the LED 130 will not be activated and will not light up. In other embodiments, the LED 130 may flash (e.g., at a dimmer level) when there is no data signal.

Figure 3:
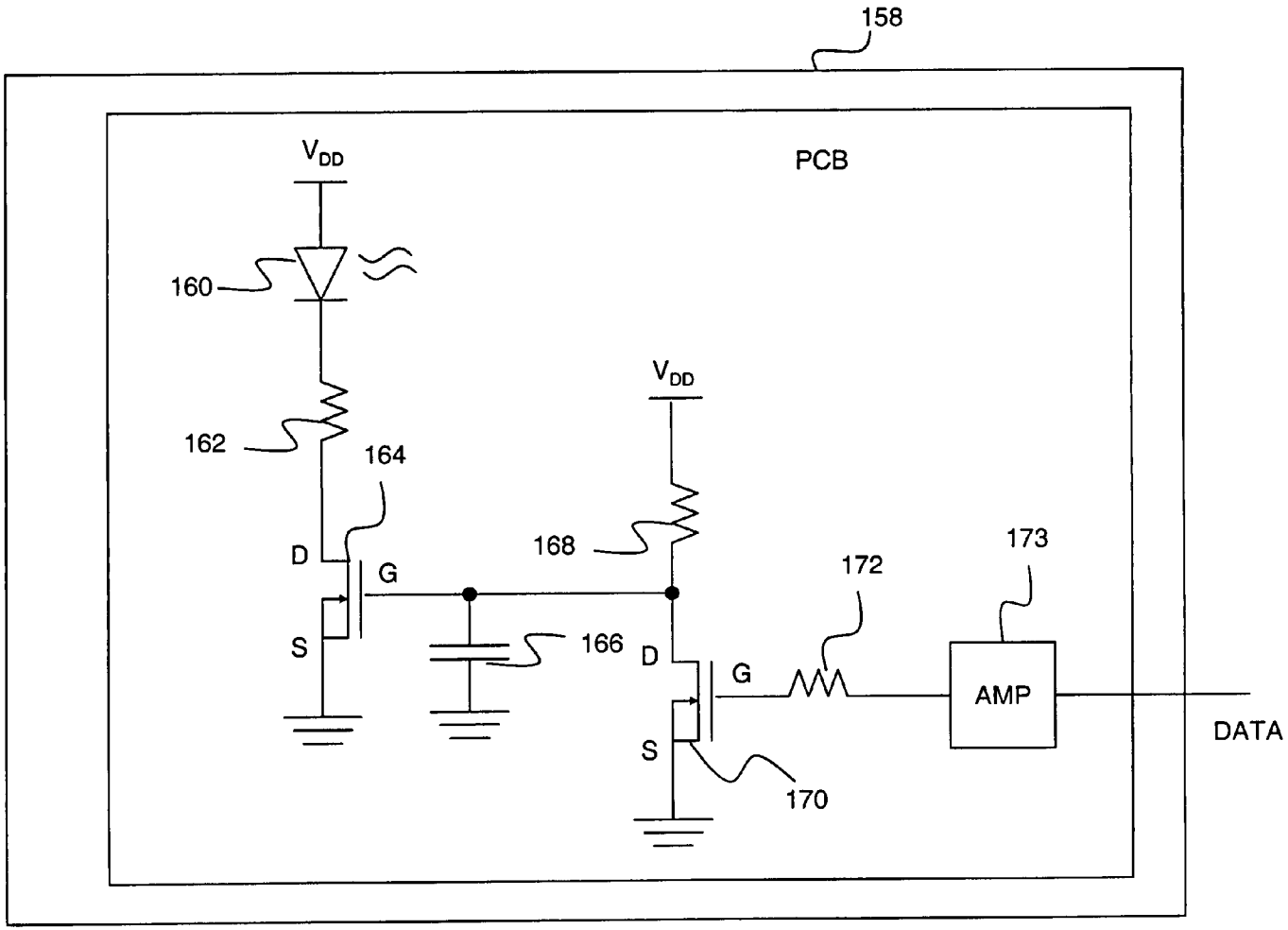
FIG. 3 is a schematic diagram of a connector in another exemplary embodiment in accordance with aspects of the present invention.

FIG. 3 is a schematic diagram of a connector 158 of a cable in another exemplary embodiment in accordance with aspects of the present invention. The schematic diagram of FIG. 3 is a simplified representation of a connector; in practice, of course, a connector would contain other components, such as pins, wires and the like. The circuitry illustrated on the schematic diagram of FIG. 3 is mounted on a PCB, and may also be referred to as a filtering circuit or detection circuitry.

The connector 158, for example, may be applied as the connector 108 and/or the connector 109 of FIG. 1. The connector 158 has a traffic indicator in a form of LED 160. Hence, the LED 160 may correspond to the traffic indicator 110 and/or the traffic indicator 111. If the cable carries power in one of its wires, the voltage source $V_{DD}$ for the LED 160 may be provided by the power in the cable. For example, if the connector 158 is a USB connector, voltage source $V_{DD}$ may be supplied by its power pin/wire. If power is not available in any of the wires, the $V_{DD}$ may be supplied by an external battery/AC power. Further, in case of a USB cable, data received by the connector 158 may be a USB DM (Data −) signal. The wire that carries data may be referred to as a data line.

In the connector 158, the LED 160 is disposed between the voltage source $V_{DD}$ and a resistor 162. The other end of the resistor 162 is coupled to a drain of a transistor 164, which is a FET, such as NDS7002 available from Fairchild Semiconductor. In other embodiments, other types of suitable transistors may be used.

A source of the transistor 164 is coupled to ground. The data is received by an amplifier 173 in the connector 158 for amplification of the data signal. The amplifier 173, for example, may be an op-amp. The amplified data is then applied through a resistor 172 at a gate of a transistor 170, which is also a FET, such as NDS7002. In other embodiments, the amplifier 173 may not be used, and the received data may be directly applied to the resistor 172.

The transistor 170 detects (i.e., senses) the communications taking place on the data line without creating a significant signal drain on the line so as to attenuate the data signal. A source of the transistor 170 is coupled to ground, and a drain of the transistor 170 is coupled to $V_{DD}$ via a resistor 168. The drain is also coupled to a gate of the transistor 164 so as to drive it, and to ground via a capacitor 166.

In operation, the data turns the transistor 170 on and off, which in turn, results in the transistor 164 being turned on and off. For example, when the data signal is high, the transistor 170 turns on, and pulls down the voltage (towards ground) at the gate of the transistor 164, thereby turning it off. Hence, when the data signal is high, substantially no current flows in the LED 160, and no light is generated.

When the data signal is low, the transistor 170 turns off, and its drain is pulled high (towards $V_{DD}$), thereby applying a high voltage at the gate of the transistor 164 so as to turn it on. Therefore, when the data signal is low, current flows through the LED 160, and light is generated to indicate that there is traffic in the cable connected to the connector 158. If there is no data signal, the LED 160 will not be activated and will not light up. In other embodiments, the LED 160 may flash (e.g., at a dimmer level) when there is no data signal.

Figure 4:
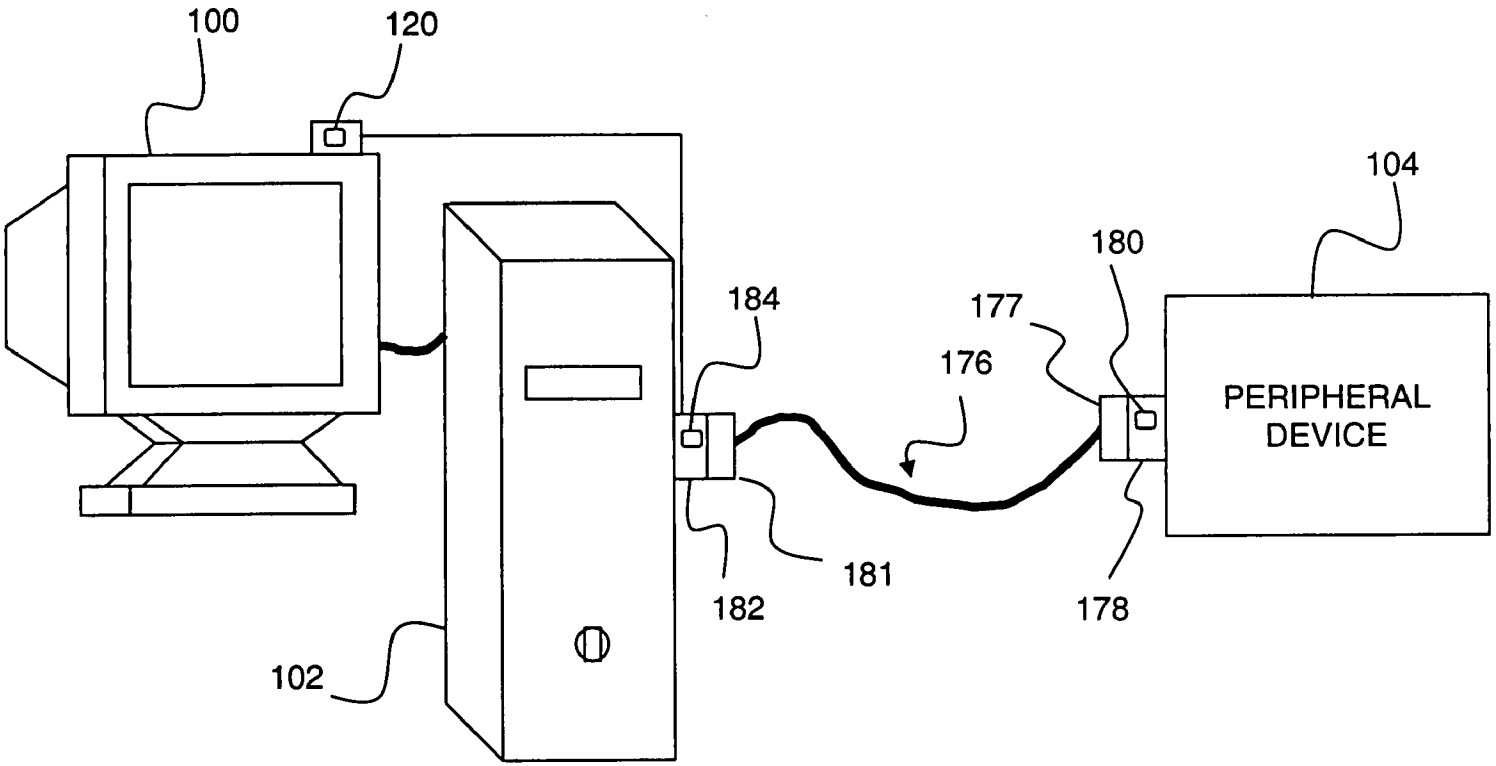
FIG. 4 is a system diagram of a computer and a peripheral device connected over a cable and an adapter having traffic indicator in an exemplary embodiment in accordance with aspects of the present invention.

FIG. 4 is a system diagram of a computer 102 and a peripheral device 104 connected by a cable 176, an adapter 178 having a traffic indicator 180, and an adapter 182 having a traffic indicator 184 in another exemplary embodiment in accordance with aspects of the present invention. The cable 176 is a standard cable having standard connectors 177 and 181 that meet parallel or serial communication standard, such as, USB (Universal Serial Bus), FireWire, COM, LPT, SCSI standard or the like. Use of the standard cable may be desirable in some cases over using the cable 106 having a traffic indicator of FIG. 1 because cost associated with acquiring new cables may be avoided if existing standard cables are used.

Instead of replacing the standard cable 176, the adapter 178 is placed between the connector 177 on the cable 176 and the peripheral device 104. Similarly, the adapter 182 is placed between the connector 181 on the cable 176 and the computer 102. The adapters 178 and 182 may, for example, receive power from the cable to which it is connected. While the adapters are coupled to both ends of the cable 176 in the system illustrated in FIG. 4, in practice, an adapter may be coupled to either end, but not both, of the cable to give a visual indication (e.g., light flashing) of traffic in the cable 176.

The adapters 178 and 182 should each have a first plug that is capable of interfacing (e.g., electrically and physically coupling) with the cable 176 (through the connector 177 and the connector 181, respectively) and a second plug that is capable of interfacing with a connector on the peripheral device 104 and the computer 102, respectively.

The circuitry for detecting and visually indicating the data signal in the adapters 178 and 182, for example, may be similar to the schematic diagram illustrated in the connector 128 of FIG. 2 and/or the connector 158 of FIG. 3. For example, the signals between the connector 177 and the peripheral device 104 may pass through the adapter 178. Similarly, the signal between the connector 181 and the computer 102 may pass through the adapter 182.

The data signal at either or both ends of the cable, for example, may be coupled to adapter circuitry that is substantially the same as the circuitry illustrated in FIG. 2 and/or FIG. 3. This way, the traffic indicator 180 and/or the traffic indicator 184 can visually indicate the traffic on the cable 176. Here, the traffic indicators 180 and/or 184 may correspond to either the LED 130 of FIG. 2 or the LED 160 of FIG. 3.

In the exemplary embodiment of FIG. 4, a traffic indicator 120 (e.g., one or more LEDs) is mounted on the display device 100 so that it is easily visible to the user. The traffic indicator 120, for example, is electrically connected to the adapter 182 to receive a detection signal used to operate the traffic indicator 120. The traffic indicator 120 may also be located at other visible locations.

Figure 5:
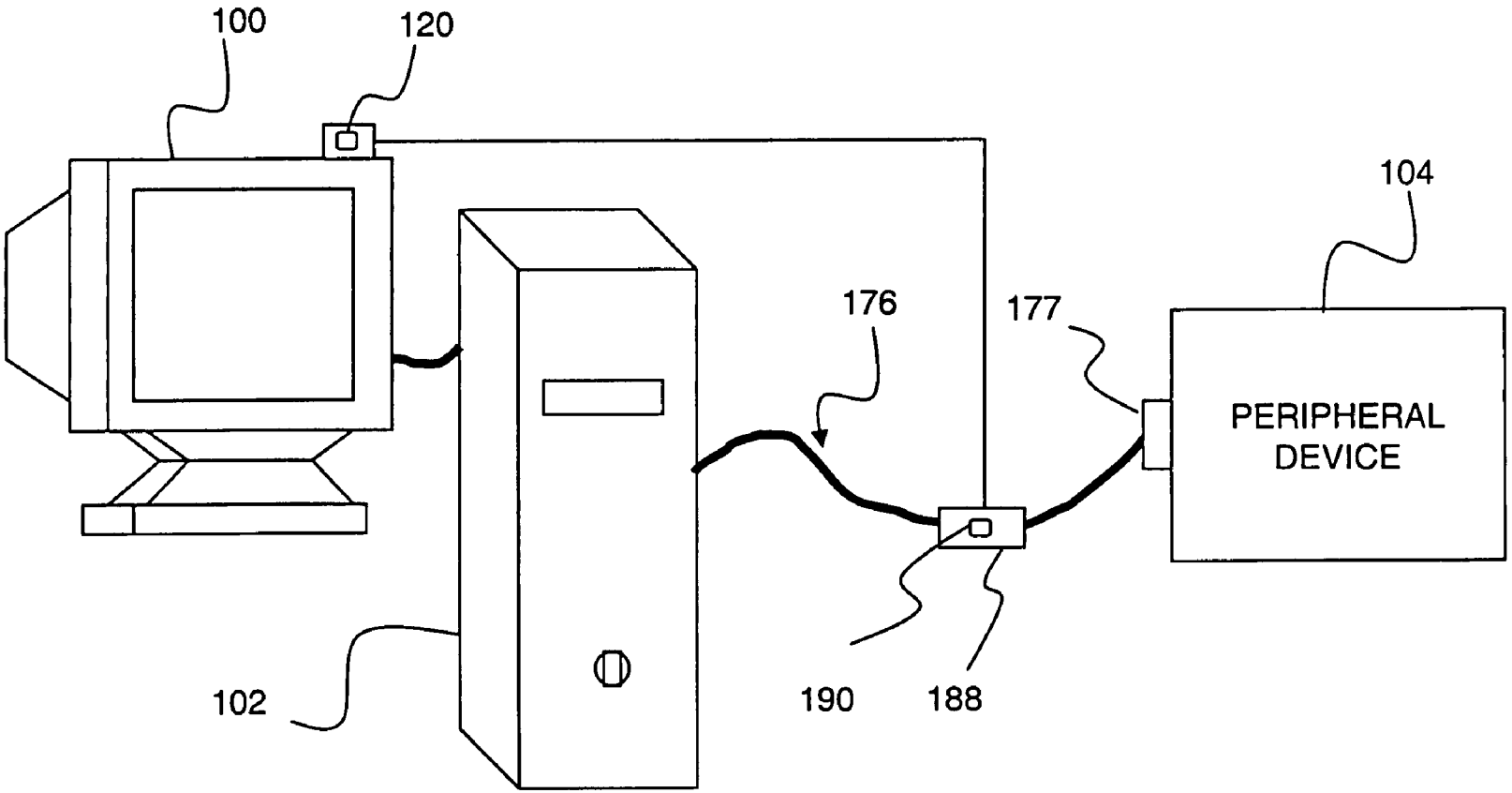
FIG. 5 is a system diagram of a computer and a peripheral device connected by a cable whose traffic is detected by a traffic detector in an exemplary embodiment in accordance with aspects of the present invention.

FIG. 5 is a system diagram of a computer 102 and a peripheral device 104 connected by the cable 176 whose traffic is detected by a traffic indicator 190 on a traffic detector 188 in an exemplary embodiment in accordance with aspects of the present invention. The traffic detector 188 may be formed at least partly from a flexible material that can wrap around the cable 176. In the system diagram of FIG. 5, the standard cable 176 is used without any adapter between the connector 177 and the peripheral device 104. Of course, such adapter may also be used in addition to the traffic detector 188 if desired.

When there is traffic in the cable 176, the signals in the cable generate electromagnetic radiation that can be detected by the traffic detector 188. The traffic detector 188 may have detection circuitry therein for such detection of electromagnetic radiation. Such detection circuitry should generate a detection signal in response to traffic (or activity) in the cable 176, and provide it to the traffic indicator 190. In response, the traffic indicator 190 flashes in accordance with the level of the signals in the traffic. Detection of electromagnetic radiation is well known to those skilled in the art.

In the exemplary embodiment of FIG. 5, a traffic indicator 120 (e.g., one or more LEDs) is mounted on the display device 100 so that it is easily visible to the user. The traffic indicator 120, for example, is electrically connected to the traffic detector 188 to receive a detection signal used to operate the traffic indicator 120. The traffic indicator 120 may also be located at other visible locations.

Figure 6:
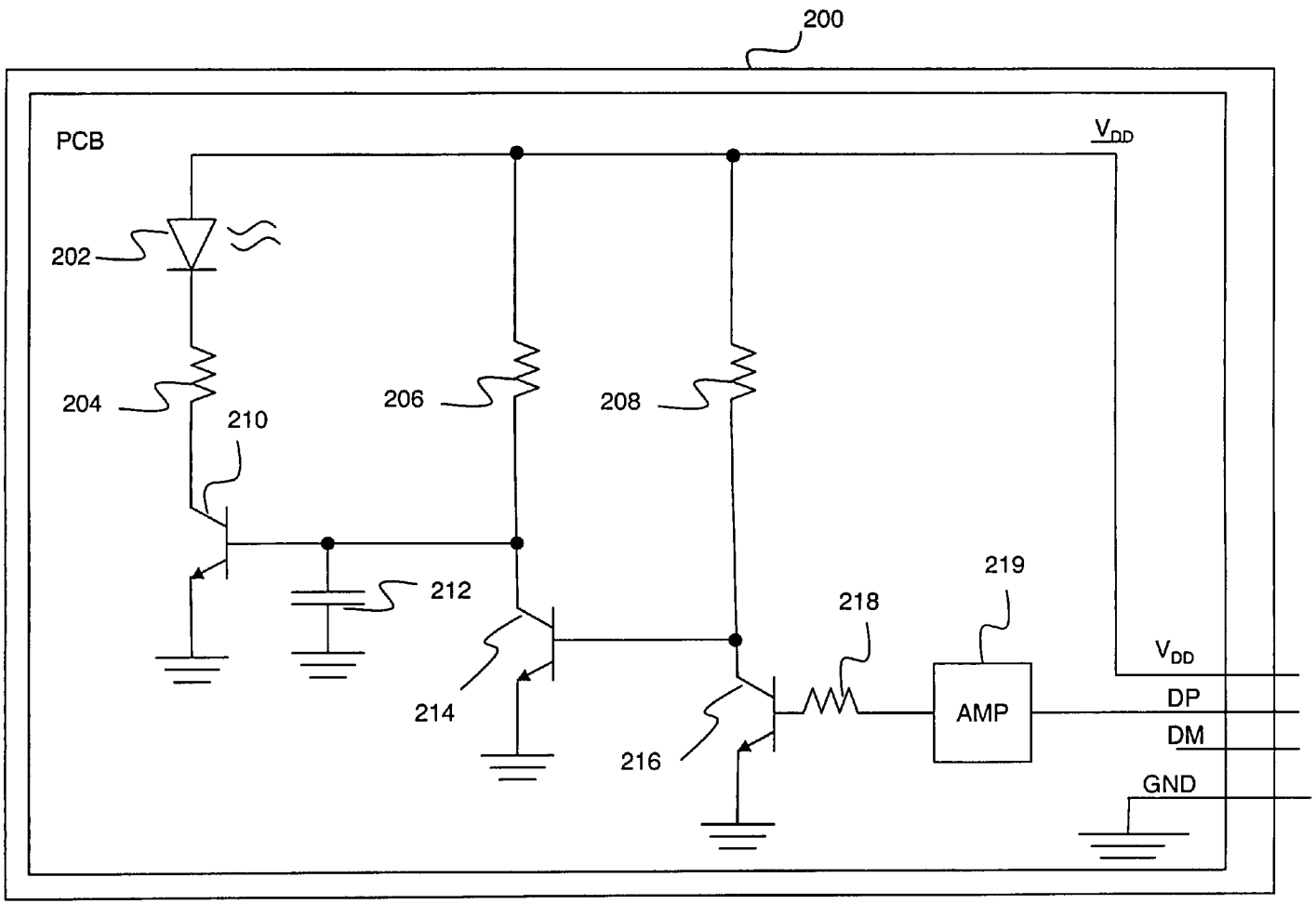
FIG. 6 is a schematic diagram of a connector in yet another exemplary embodiment in accordance with aspects of the present invention.

FIG. 6 is a schematic diagram of a connector 200 of a cable in an exemplary embodiment in accordance with aspects of the present invention. The schematic diagram of FIG. 6 is a simplified representation of a connector; in practice, of course, a connector would contain other components, such as pins, wires and the like. The circuitry illustrated on the schematic diagram of FIG. 6 is mounted on a PCB, and may also be referred to as a filtering circuit or detection circuitry. The connector 200, for example, may be a standard USB connector having pins for $V_{DD}$, DP, DM and GND, respectively.

The connector 200, for example, may be applied as the connector 108 and/or the connector 109 of FIG. 1. The schematic diagram of FIG. 6, for example, may also be applied in an adapter for detecting and visually indicating traffic in the cable. For example, adapter circuitry for detecting and visually indicating traffic in the adapter 178 and/or the adapter 182 of FIG. 4 may be substantially the same as the circuitry of FIG. 6.

The connector 200 has a traffic indicator in a form of LED 202. Hence, the LED 202 may correspond to the traffic indicator 110 and/or the traffic indicator 111 of FIG. 1. Further, when the circuitry of FIG. 6 is used in the adapter 178 and/or the adapter 182 of FIG. 4, the LED 202 may correspond to the traffic indicator 180 and/or the traffic indicator 184 of FIG. 4. If the cable carries power in one of its wires, the voltage source $V_{DD}$ for the LED 202 may be provided by the power in the cable. For example, if the connector 200 is a USB connector, voltage source $V_{DD}$ may be supplied by its power pin/wire. If power is not available in any of the wires, the $V_{DD}$ may be supplied by an external battery/AC power. Further, in case of a USB cable, data received by the connector 200 may be a USB DP signal. The wire that carries data may be referred to as a data line.

In the connector 200, the LED 202 is disposed between the voltage source $V_{DD}$ and a resistor 204. The other end of the resistor 204 is coupled to a collector of a transistor 210, which is a bipolar transistor, such as 2N3904 NPN switching transistor available from Philips Semiconductors. An emitter of the transistor 210 is coupled to ground. The resistor 204, for example, may have a value of 510 Ω or one of other suitable values. In other embodiments, other types of suitable transistors may be used.

The data is received by an amplifier 219 in the connector for amplification of the data signal. The amplifier 219, for example, may be an op-amp. The amplified data is then applied through a resistor 218 at a base of a transistor, such as N3904. In other embodiments, the amplifier 219 may not be used and the received data may be directly applied to resistor 218.

The transistor 216 detects (i.e., senses) the communications taking place on the data line without creating a significant signal drain on the line so as to attenuate the data signal. An emitter of the transistor 216 is coupled to ground, and a collector of the transistor 216 is coupled to $V_{DD}$ via a resistor 208. For example, the resistors 218 and 208 may have values of 5.1KΩ and 10KΩ, respectively. These resistors may also have other suitable values.

The collector of the transistor 216 is also coupled to a base of a transistor 214 so as to drive it. The transistor 214 is also a bipolar transistor, such as 2N3904. A collector of the transistor 214 is coupled to $V_{DD}$ through a resistor 206, which for example, may have a value of 10KΩ. The resistor 206 may also have one of other suitable values. The collector of the transistor 214 is also coupled to a base of the transistor 210 and also to a capacitor 212, which for example may have a value of 1000 pico farad (pF) or any other suitable value. The other side of the capacitor 212 is coupled to ground. Further, an emitter of the transistor 214 is coupled to ground.

In operation, the DP signal turns the transistor 216 on and off, which in turn, results in the transistor 214 being turned on and off. For example, when the data signal is high, the transistor 216 turns on, and pulls down the voltage (towards ground) at the base of the transistor 214, thereby turning it off. When the transistor 214 is in an off-state, the base of the transistor 210 is pulled high, thereby turning on the transistor 210. Hence, when the data signal is high, current flows through the LED 202, and light is generated to indicate that there is traffic in the cable connected to the connector 200.

When the data signal is low, the transistor 216 turns off, and its collector is pulled high (towards $V_{DD}$), thereby applying a high voltage at the base of the transistor 214 so as to turn it on. When the transistor 214 is in an on-state, current flows through the resistor 206, thereby lowering voltage at the collector of the transistor 214. When the voltage at the collector of the transistor 214 is lowered, the voltage applied at the base of the transistor 210 is lowered also, thereby turning the transistor 210 off. Therefore, when the data signal is low, current does not flow through the LED 202, and light is not generated. If there is no data signal, the LED 202 will not be activated and will not light up. In other embodiments, the LED 202 may flash (e.g., at a dimmer level) when there is no data signal.

The transistors in FIG. 6 are illustrated as NPN bipolar transistors. In other embodiments, the transistors may be PNP bipolar transistors or any other suitable transistors.

Figure 7:
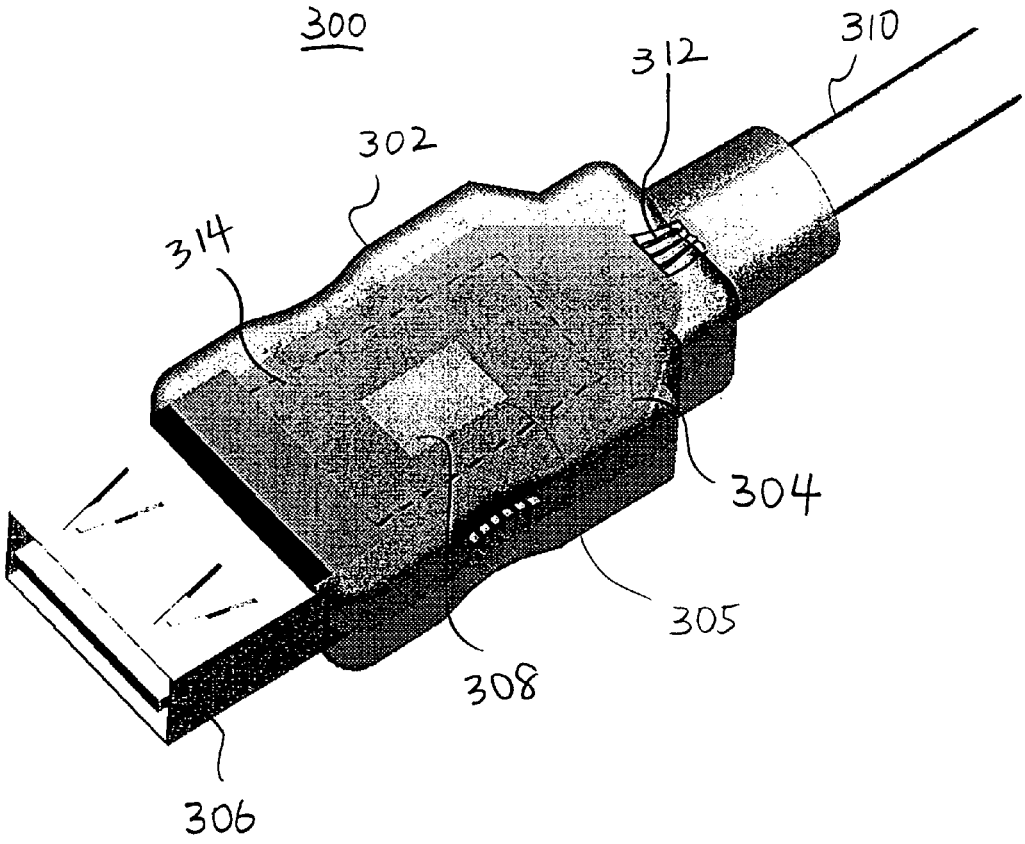
FIG. 7 is a perspective view of a cable connector according to an exemplary embodiment of the present invention.

FIG. 7 is a perspective view of a cable connector 300 according to an exemplary embodiment of the present invention. The connector 300 includes a generally rectangular shaped socket 306, which is configured as a female connector. The socket 306 interfaces with a printed circuit board (PCB) 314 (shown as a box with dotted lines), which is adjacent to and coupled to the socket 306. The PCB 314 has mounted thereon an LED 308. The PCB 314 also has mounted thereon circuitry (not shown; e.g., detection circuitry of FIG. 2, 3 or 6) for sensing the data traffic on a cable 310, and also for lighting the LED 308 when there is traffic on the cable 310. The circuitry on the PCB 314 is also coupled to wires 312 of the cable 310. The LED 308 may be a flashing LED or any other type of LED.

The connector 300 includes an outer casing 302 and a generally rectangular shaped inner casing 304. The inner casing 304 has a tapered end on the side of the cable 310. The inner casing 304 is first used to encase the PCB 314. Since the LED 308 is mounted on the PCB 314, an opening 305 is formed on the inner casing 304 to allow the visible light to exit through the opening. In other embodiments, the opening 305 may be covered with a transparent or semi-transparent material. In still other embodiments, the inner casing may be made of a transparent or semi-transparent material such that the opening is not needed to allow the visible light to exit the inner casing.

The outer casing 302 is made of a transparent or semi-transparent material such that the light generated by the LED 308 can be seen through the outer casing 302. By encasing the PCB 314 in the inner casing 304 and by enveloping both the inner casing 304 and a portion of the socket 306 using the outer casing 302, a cable connector having a sturdy design is provided.

Figure 8:
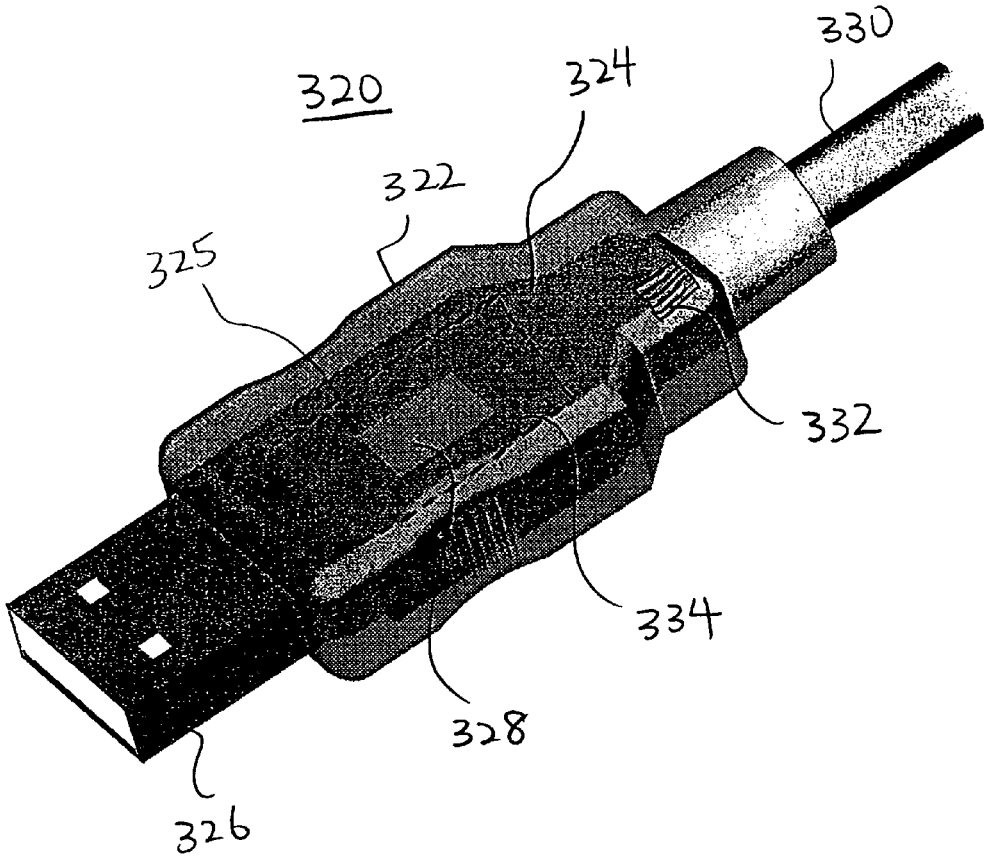
FIG. 8 is a perspective view of a cable connector according to another exemplary embodiment of the present invention.

FIG. 8 is a perspective view of a cable connector 320 according to another exemplary embodiment of the present invention. The connector 320 is similar to the connector 300 of FIG. 7, except that the connector 320 includes a generally rectangular shaped plug 326, which is configured as a male connector. The plug 326 interfaces with a printed circuit board (PCB) 334 (shown as a box with dotted lines), which is adjacent to and connected to the plug 326. The PCB 334 has mounted thereon an LED 328. The PCB 334 also has mounted thereon circuitry (not shown; e.g., detection circuitry of FIG. 2, 3 or 6) for sensing the data traffic on a cable 330, and also for lighting the LED 328 when there is traffic on the cable 330. The circuitry on the PCB 334 is also coupled to wires 332 of the cable 330. The LED 328 may be a flashing LED or any other type of LED.

The connector 320 includes an outer casing 322 and a generally rectangular shaped inner casing 324. The inner casing 324 has a tapered end on the side of the cable 330. The inner casing 324 is first used to encase the PCB 334. Since the LED 328 is mounted on the PCB 334, an opening 325 is formed on the inner casing 324 to allow the visible light to exit through the opening. In other embodiments, the opening 325 may be covered with a transparent or semi-transparent material. In still other embodiments, the inner casing may be made of a transparent or semi-transparent material such that the opening is not needed to allow the visible light to exit the inner casing.

The outer casing 322 is made of a transparent or semi-transparent material such that the light generated by the LED 328 can be seen through the outer casing 322. By encasing the PCB 334 in the inner casing 324 and by enveloping both the inner casing 324 and a portion of the socket 326 using the outer casing 322, a cable connector having a sturdy design is provided.

Figure 9:
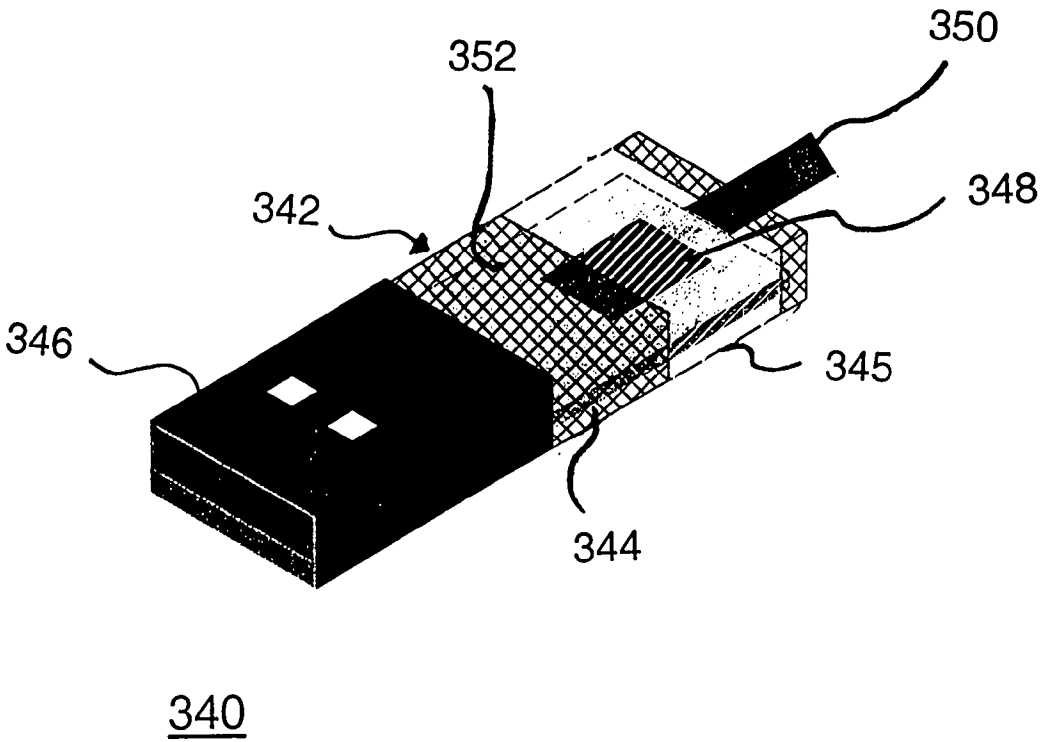
FIG. 9 is a perspective view of a cable connector according to yet another exemplary embodiment of the present invention.

FIG. 9 is a perspective view of a cable connector 340 according to yet another exemplary embodiment of the present invention. The connector 340 includes a plug 346, which is configured as a male connector. The plug 346 interfaces with a printed circuit board (PCB) 352, which is adjacent to and coupled to the plug 346. The PCB 352 has mounted thereon an LED 348. The PCB 352 also has mounted thereon circuitry (not shown; e.g., detection circuitry of FIG. 2, 3 or 6) for sensing the data traffic on a cable 350, and also for lighting the LED 348 when there is traffic on the cable 350. The circuitry on the PCB 352 is also coupled to wires of the cable 350. The LED 348 may be a flashing LED or any other type of LED.

The connector 340 includes a generally rectangular shaped casing 342, which has a first section 345 around the LED 348 and a second section 344. The first section 345 is either transparent or semi-transparent, and allows the light generated by the LED 348 to exit the casing 342. The second section 344 surrounds the first section 345, and is transparent, semi-transparent, or transparent with texture. The casing 342, for example, may be used as an inner casing for the connector of FIG. 7 and/or FIG. 8.

Figure 10:
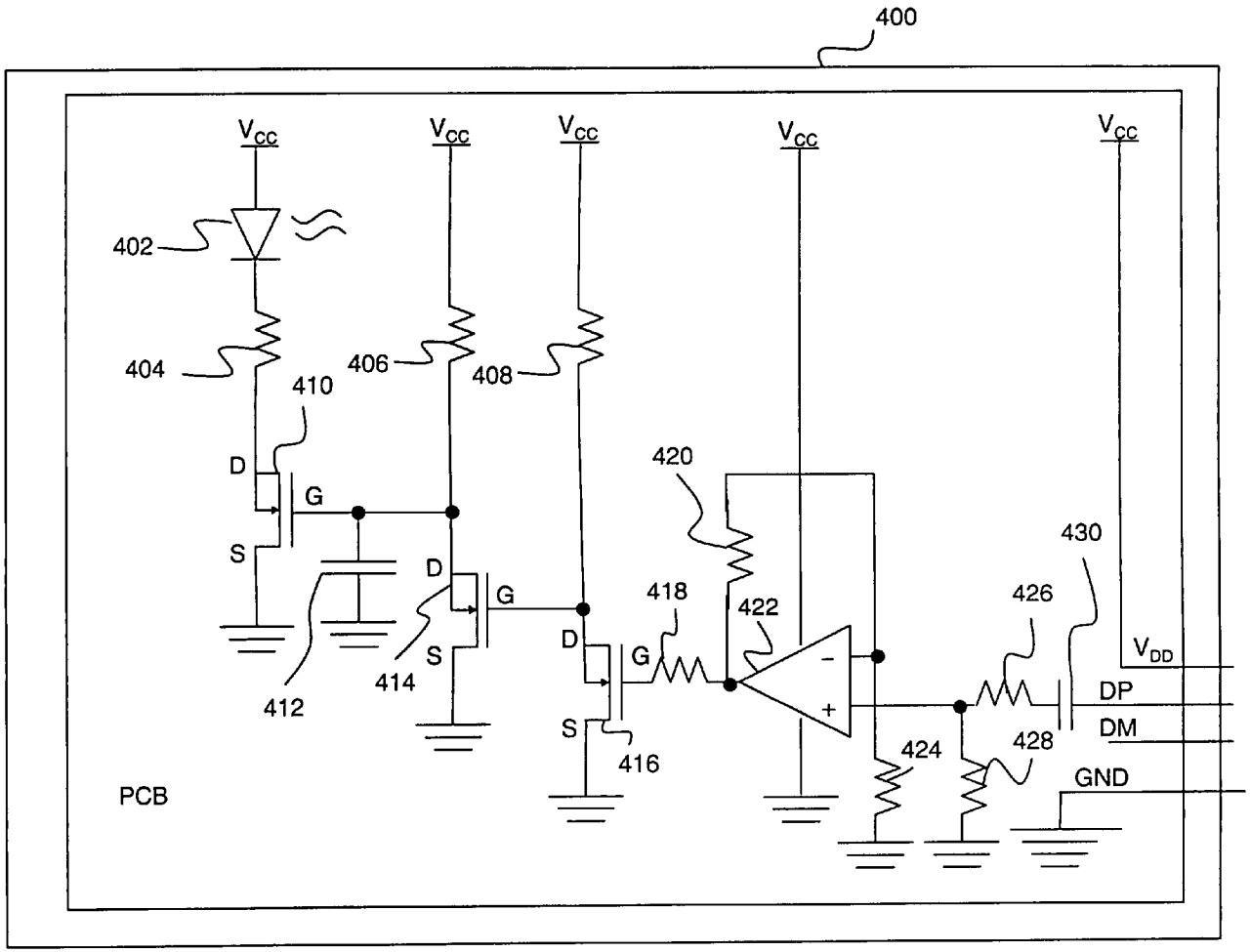
FIG. 10 is a schematic diagram of a connector in still another exemplary embodiment in accordance with aspects of the present invention.

FIG. 10 is a schematic diagram of a connector 400 in still another exemplary embodiment in accordance with aspects of the present invention. The connector 400 of FIG. 10 is similar to the connector 200 of FIG. 6, except that the connector 400 has FETs 410, 414 and 416 instead of the NPN bipolar transistors 210, 214 and 216 in the connector 200 of FIG. 6. The FETs 410, 414 and 416, for example, may be 2N7002 N-Channel Enhancement-Mode Vertical DMOS FETs available from Supertex Inc.

The FET 410 is coupled via an LED 402 and a resistor 404 (e.g., 510 Ω) to Vcc. The FETs 414 and 416 are coupled via resistors 406 (e.g., 10 kΩ) and 408 (e.g., 10 kΩ), respectively, to Vcc. A gate of the transistor 414 is coupled to a node between the resistor 408 and the FET 416. A capacitor 412 (e.g., 1000 pF/25V) is coupled between a gate of the FET 410 and ground, and to a node between the resistor 406 and the FET 414. A gate of the transistor 416 is coupled via a resistor 418 (e.g., 5.1 kΩ) to an op-amp 422. The op-amp 422, for example, may be LM358 low power dual op-amp available from National Semiconductor. In other embodiments, other types of transistors and/or an op-amp may be used. Also, various different suitable values may be used for the discrete components, such as the resistors and capacitors as those skilled in the art would appreciate.

The positive data signal (DP) is received by the connector 400 and applied through a capacitor 430 (e.g., 0.1μ F/25V) at a resistor 426 (e.g., 2.4 kΩ). The capacitor 430, hence, operates as a high pass filter to filter out low frequency. The other end of the resistor 426 is coupled to ground via a resistor 428 (e.g., 1 MΩ), and also applied at a positive input of the op-amp 422. An output of the op-amp 422 is fed back via a resistor 420 (e.g., 1 MΩ) into its negative input. The negative input is also coupled to ground via a resistor 424 (e.g., 10 kΩ).

The circuitry of the connector 400, for example, may be applied to the connectors 108, 109 of FIG. 1, the adapters 178, 182 of FIG. 4 and/or the traffic detector 188 of FIG. 5.

Figure 12:
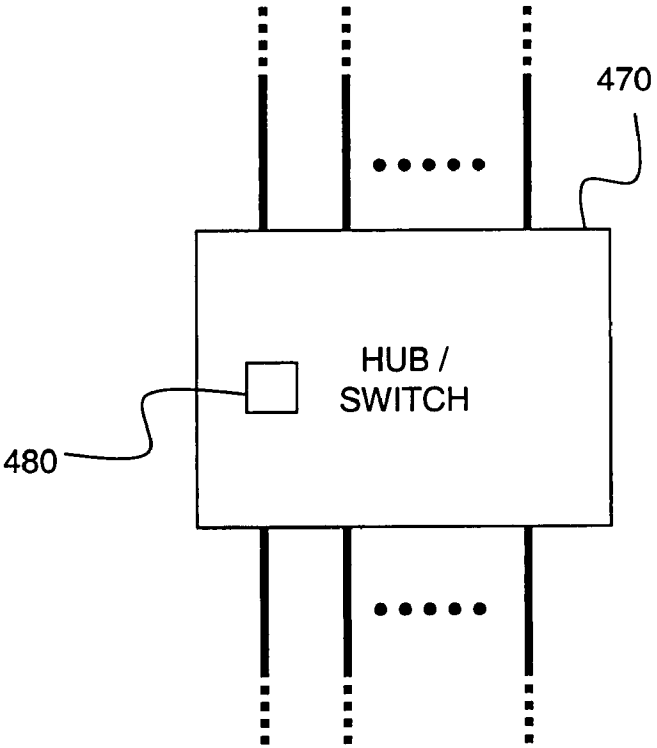
FIG. 12 is a hub/switch in another exemplary embodiment in accordance with aspects of the present invention.
Figure 11:
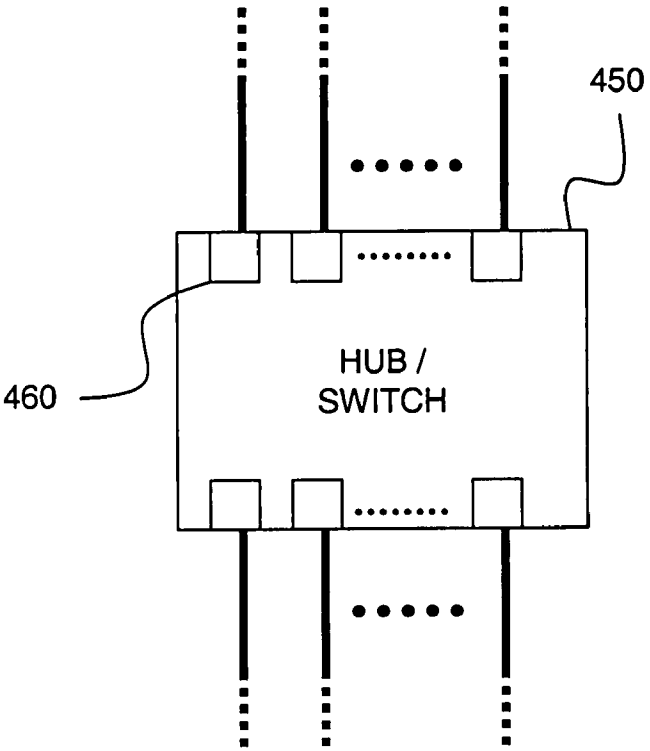
FIG. 11 is a hub/switch in an exemplary embodiment in accordance with aspects of the present invention.

FIGS. 11 and 12 are two exemplary embodiments of a hub or a switch in accordance with aspects of the present invention. To the hub/switch 450 and the hub/switch 470 of FIGS. 11 and 12, a number of USB, FireWire and/or other types of cables may be connected. These cables may also be connected at the other end to various different computers, peripheral devices, and the like, for exchanging data with one or more other connected devices via the hub/switch 450 or 470.

The hub/switch 460 includes a plurality of detection circuitry/traffic indicators 460, one per cable. However, the hub/switch 470 includes only one detection circuitry/traffic indicator 480. For example, the cables connected to the hub/switch 470 may be coupled in series and/or chained such that only one detection circuitry/traffic indicator may be sufficient. In other embodiments, the number of detection circuitry/traffic indicators may be more than one but less than the total number of connected cables. The detection circuitry/traffic indicators 460 or 480 may be the same as or similar to the circuitry of FIGS. 2, 3, 6 and/or 10.

It will be appreciated by those of ordinary skill in the art that the invention can be embodied in other specific forms without departing from the spirit or essential character thereof. The present description is therefore considered in all respects to be illustrative and not restrictive, the scope of the invention to be determined by the appended claims and their equivalents.

The invention claimed is:

1. A cable capable of providing a visual indication of traffic, said cable comprising:

one or more wires; and at least one connector connected to the wires, said connector having detection circuitry capable of detecting the traffic on the cable and generating a detection signal responsive to the traffic, and a traffic indicator coupled to the detection circuitry to provide the visual indication of the traffic responsive to the detection signal, said detection circuitry comprising:

driving circuitry coupled to at least one said wire, said at least one said wire carrying a data signal; and a transistor coupled to the driving circuitry and the traffic indicator, wherein the driving circuitry drives the transistor responsive to the data signal to generate the detection signal, which is used to drive the traffic indicator, and wherein the driving circuitry comprises:

a driving transistor having a first electrode, a second electrode and a third electrode, wherein the first electrode is coupled to said at least one data signal carrying wire, the second electrode is coupled to power and a gate of the transistor, and the third electrode is coupled to ground, and wherein the transistor turns on when the driving transistor turns off, and the transistor turns off when the driving transistor turns on, thereby generating the detection signal.

2. The cable of claim 1, wherein said cable is selected from a group consisting of USB, FireWire, COM, LPT and SCSI cables.

3. The cable of claim 1, wherein the traffic indicator comprises one selected from a group consisting of a light emitting diode (LED), an electro-luminescent lamp, a translucent connector end and a translucent wire covering.

4. The cable of claim 1, wherein at least one of the wires carries power, and the traffic indicator receives power from said at least one of the wires that carries power.

5. The cable of claim 1, wherein the driving circuitry comprises a diode.

6. The cable of claim 1, wherein said at least one connector comprises an inner casing, an outer casing and a plug, wherein the inner casing at least partially envelopes the detection circuitry, the outer casing at least partially envelopes the inner casing, and the plug is coupled to said one or more wires and the detection circuitry.

7. The cable of claim 6, wherein the inner casing has an opening formed thereon for allowing light generated by the traffic indicator to exit the inner casing.

8. The cable of claim 6, wherein at least a portion of at least one of the inner casing and the outer casing is either transparent or semi-transparent to allow at least a portion of light generated by the traffic indicator to exit the connector.

9. The cable of claim 1, wherein the driving circuitry comprises ail amplifier for amplifying the data signal.

10. A cable capable of providing a visual indication of traffic, said cable comprising:

one or more wires; and at least one connector connected to the wires, said connector having detection circuitry capable of detecting the traffic on the cable and generating a detection signal responsive to the traffic, and a traffic indicator coupled to the detection circuitry to provide the visual indication of the traffic responsive to the detection signal, said detection circuitry comprising:

driving circuitry coupled to at least one said wire, said at least one said wire carrying a data signal; and a transistor coupled to the driving circuitry and the traffic indicator, wherein the driving circuitry drives the transistor responsive to the data signal to generate the detection signal, which is used to drive the traffic indicator, and wherein the driving circuitry comprises:

first and second driving transistors, each having a first electrode, a second electrode and a third electrode, wherein for the first driving transistor, the first electrode is coupled to said at least one data signal carrying wire, the second electrode is coupled to power, and the third electrode is coupled to ground, wherein for the second driving transistor, the first electrode is coupled to the second electrode of the first transistor, the second electrode is coupled to power and a gate of the transistor, and the third electrode is coupled to ground, and wherein the transistor turns on when the first driving transistor turns on, and the transistor turns off when the first driving transistor turns off, thereby generating the detection signal.

11. An adapter for a cable having one or more wires to provide a visual indication of traffic on the cable, said adapter comprising:

a first plug for interfacing with the cable;

a second plug for interfacing between the first plug and an electronic device: and detection circuitry capable of detecting the traffic on the cable and generating a detection signal responsive to the traffic, and a traffic indicator coupled Lo the detection circuitry to provide the visual indication of the traffic responsive to the detection signal, said detection circuitry comprising:

driving circuitry coupled to at least one said wire in use, said at least one said wire carrying a data signal; and a transistor coupled to the driving circuitry and the traffic indicator, wherein the driving circuitry in use drives the transistor responsive to the data signal to generate the detection signal, which is used to drive the traffic indicator, wherein at least one of the wires carries power, and the traffic indicator in use receives power from said at least one wire that carries power, and wherein the driving circuitry comprises a driving transistor having a first gate, a second gate and a third gate, wherein, in use, the first gate is coupled to said at least one data signal carrying wire, the second gate is coupled to power and a gate of the transistor, and the third gate is coupled to ground, and wherein, in use, the transistor turns on when the driving transistor turns off, and the transistor turns off when the driving transistor turns on, thereby generating the detection signal.

12. The adapter of claim 11, wherein said adapter is capable of interfacing with a cable selected from a group consisting of USB, FireWire, COM, LPT and SCSI cables.

13. The adapter of claim 11, wherein the traffic indicator comprises one selected from a group consisting of a light emitting diode (LED), an electro-luminescent lamp, a translucent connector end and a translucent wire covering.

14. The adapter of claim 11, wherein the driving circuitry comprises a diode.

15. The adapter of claim 11, wherein the driving circuitry comprises an amplifier for amplifying the data signal.

16. An adapter for a cable having one or more wires to provide a visual indication of traffic on the cable, said adapter comprising:

a first plug for interfacing with the cable;

a second plug for interfacing between the first plug and an electronic device; and detection circuitry capable of detecting the traffic on the cable and generating a detection signal responsive to the traffic, and a traffic indicator coupled to the detection circuitry to provide the visual indication of the traffic responsive to the detection signal, said detection circuitry comprising:

driving circuitry coupled to at least one said wire in use, said at least one said wire carrying a data signal; and a transistor coupled to the driving circuitry and the traffic indicator, wherein the driving circuitry in use drives the transistor responsive to the data signal to generate the detection signal, which is used to drive the traffic indicator, and wherein the driving circuitry comprises:

first and second driving transistors, each having a first electrode, a second electrode and a third electrode, wherein, in use, for the first driving transistor, the first electrode is coupled to said at least on data signal carrying wire, the second electrode is coupled to power, and the third electrode is coupled to ground, wherein, in use, for the second driving transistor, the first electrode is coupled to the second electrode of the first transistor, the second electrode is coupled to power and a gate of the transistor, and the third electrode is coupled to ground, and wherein, in use, the transistor turns on when the first driving transistor turns on, and the transistor turns off when the first driving transistor turns off, thereby generating the detection signal.

* * * * *

UNITED STATES PATENT AND TRADEMARK OFFICE

CERTIFICATE OF CORRECTION

PATENT NO. : 7,019,658 B1
APPLICATION NO. : 10/677994
DATED : March 28, 2006
INVENTOR(S) : Erickson et al.

It is certified that error appears in the above-identified patent and that said Letters Patent is hereby corrected as shown below:

In the Claims

| | |
|---|---|
| Column 11, line 41, Claim 9 | Delete "ail",<br>Insert --an-- |
| Column 12, line 13, Claim 11 | Delete "device:",<br>Insert --device;-- |
| Column 12, line 16, Claim 11 | Delete "coupled Lo",<br>Insert --coupled to-- |
| Column 12, line 30, Claim 11 | Delete "comprises",<br>Insert --comprises:-- |
| Column 13, line 10, Claim 16 | Delete "least on",<br>Insert --least one-- |

Signed and Sealed this

Twentieth Day of March, 2007

JON W. DUDAS
*Director of the United States Patent and Trademark Office*